United States Patent [19]

Davis et al.

[11] 4,032,140

[45] June 28, 1977

[54] ADJUSTABLE STILT

[76] Inventors: Melvin R. Davis, 810 Toh-n-hah Trail, Wichita, Kans. 67212; Roy G. Howe, Jr., 310 Champa, Pratt, Kans. 67124

[22] Filed: Mar. 29, 1976

[21] Appl. No.: 671,134

[52] U.S. Cl. ..... 272/70.1
[51] Int. Cl.[2] ..... A63B 25/00
[58] Field of Search ..... 272/70.1, 70.2

[56] References Cited

UNITED STATES PATENTS

| | | | |
|---|---|---|---|
| 218,457 | 8/1879 | Schultheis | 272/70.2 X |
| 680,454 | 8/1901 | Garretson | 272/70.1 |
| 1,547,024 | 7/1925 | Byrne et al. | 272/70.1 |
| 2,477,893 | 8/1949 | Petersen | 272/70.1 |
| 2,659,087 | 11/1953 | Skaggs et al. | 272/70.1 X |
| 3,365,195 | 1/1968 | Hansburg | 272/70.1 |

FOREIGN PATENTS OR APPLICATIONS

| | | | |
|---|---|---|---|
| 609,382 | 9/1948 | United Kingdom | 272/70.1 |
| 198,610 | 6/1923 | United Kingdom | 272/70.1 |

*Primary Examiner*—Richard C. Pinkham
*Assistant Examiner*—Arnold W. Kramer
*Attorney, Agent, or Firm*—Edwin H. Crabtree; John H. Widdowson

[57] ABSTRACT

An adjustable stilt for children of all ages. The stilt includes a first tube member with a second tube member received therein for adjusting the length of the stilt. The tube members have a series of apertures therein for receiving the end of a foot stirrup bolt. The bolt secures a foot stirrup to the tube members. By removing the stirrup bolt the length of the stilt may be increased or decreased and the height of the foot stirrup above the ground surface may be adjusted. A handle for holding the stilt having a hollow collar with a series of apertures as in the tubes is attached to the upper portion of the first tube member by a handle bolt.

7 Claims, 6 Drawing Figures

ADJUSTABLE STILT

BACKGROUND OF THE INVENTION

This invention relates generally to stilts and more particularly but not by way of limitation to an improved adjustable stilt.

Heretofore there have been various designs and different types of construction of stilts having adjustable foot pieces along the length of the stilt or a stilt having a two piece construction wherein the length of the stilt may be increased or decreased. Also there are stilts which have handles or arm rests attached to the top of the stilts for holding the stilts while in use.

None of the prior art stilts disclose the novel structure of the subject invention as described herein.

SUMMARY OF THE INVENTION

The subject invention is simple in design yet rugged in construction and because of the stilt's adjustability children can quickly learn to walk on the stilts.

The invention includes a first tube member and a second tube member with apertures therein for adjusting the length of the stilt. A foot stirrup attached to the side of the tube members may be adjusted to increase or decrease the height of the stirrup above the ground surface. This combination of adjusting features is important since the length of the stilt and the height of the stirrup will be determined by the age, skill, and coordination of the stilt user.

The subject stilt includes an adjustable handle having a concave handle grip for centering the hands of the user above the center of the tube members for support while getting on and off the stilt and positioning the hand above the tube members while the stilt is being used.

The stilt further includes a foot piece and foot pad, attached to the lower portion of the second tube member thereby giving the user of the stilt greater balance and more traction while walking on an uneven or wet ground surface.

The stilt does not include any jagged edges or any protruding bolts and nuts adjacent the body of the user which may tear the clothing of the user during the use of the stilt.

The stilt does not include leather straps attached to the foot stirrup which holds the foot of the user into the stirrup. This being dangerous in case the user falls from the stilts. The foot stirrup of the stilt does include a raised lip on the outer edge of the foot stirrup to aid the user in positioning his feet adjacent the side of the tube member.

The adjustable stilt includes a vertical first tube member having an upper end portion and a lower end portion and having a plurality of apertures on opposite sides thereof and in spaced relationship along the length of the first tube member. A vertical second tube member having an upper end portion and a lower end portion is slidably received in the lower end portion of the first tube member. The second tube member also includes a plurality of apertures on the opposite sides thereof and in spaced relationship along the length of the second tube member. A horizontal foot stirrup having a stirrup bolt is received in selected apertures in the first tube member and second tube member and therethrough. The end of the bolt is attached to a locking nut for securing the tube members together and to the foot stirrup. A handle having a hollow collar integrally formed therein is attached to the upper end portion of the first tube member by a handle bolt and a locking nut.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
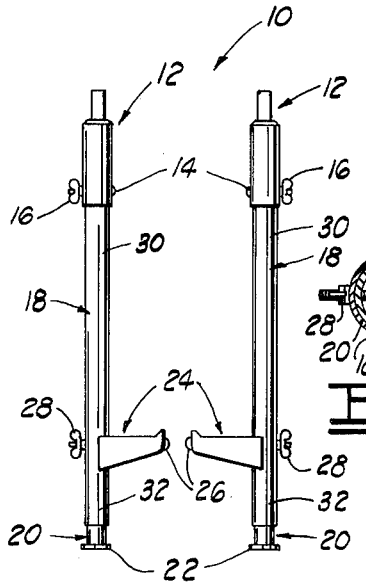
FIG. 1 is a side view of the adjustable stilts having an annular cross section.

In the drawings the adjustable stilt is designated by general reference numeral 10. Generally there are a pair of stilts 10 but for discussion purposes the stilts of the subject invention are identical and will be described as a single stilt 10.

In FIG. 1 there are shown a pair of stilts 10 having a handle 12, a first tube member 18 attached to the handle 12 by a handle bolt 14 and locking nut 16, a second tube member 20 slidably received in the first tube member 18, a foot piece 22 slidably received in the second tube member 20, and a foot stirrup 24 attached to the tube members 18 and 20 by a stirrup bolt 26 and locking nut 28. The first tube member 18 includes an upper portion 30 and a lower portion 32. The second tube member 20 includes an upper portion 34 and a lower portion 36 shown in FIG. 2.

Figure 2A:
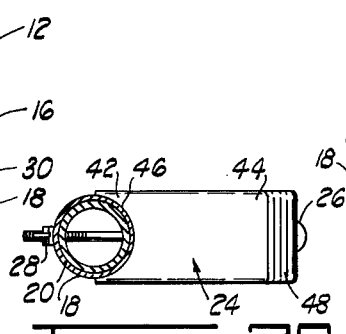
FIG. 2A illustrates a cross section of one stilt taken along lines 2A—2A shown in FIG. 2.
Figure 2:
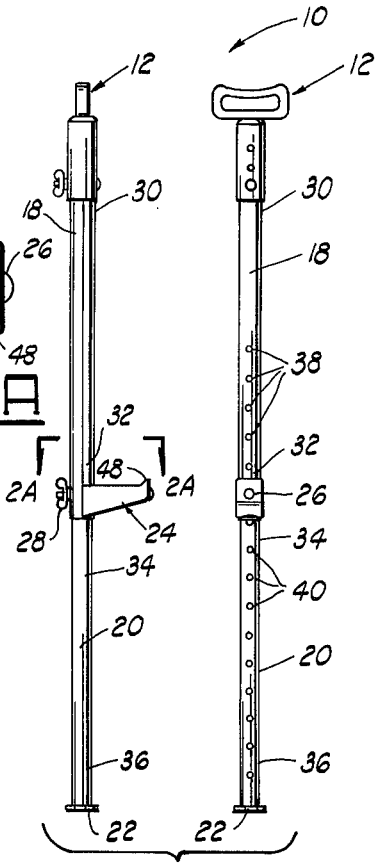
FIG. 2 illustrates a side view of one stilt and a front view of a second stilt.

In FIG. 2 the length of the stilt 10 has been increased by removing the stirrup bolt 26 and slidably adjusting the second tube member 20 in the first tube member 18. In the front view of the stilt 10 a series of apertures 38 are shown positioned on opposite sides of the first tube member 18 and in a spaced relationship thereto. The second tube 20 also includes a series of apertures 40 positioned on opposite sides of the second tube member 20 and in a spaced relationship thereto.

By properly indexing the apertures 38 and 40 of the tube members 18 and 20, the length of the stilt 10 can be adjusted accordingly and the stirrup bolt 26 inserted through the selected apertures. The locking nut 28 is then tightened on the end of bolt 26 securing the stirrup 24 and the tube members 18 and 20 together. It should be noted that not only can the length of the stilt 10 be adjusted but also the height of the stirrup 24 may be raised or lowered above the ground surface by properly selecting apertures 38 and 40 prior to inserting the stirrup bolt 26 therein.

The feature of adjusting both the length of the stilt 10 and the height of the stirrup 24 above the ground surface is important since this adjustment will be determined by the age, skill, and the coordination of the user of the stilt 10 keeping in mind his safety should he fall from the stilt 10.

In FIG. 2A a cross section of the stilt 10 is shown taken along lines 2A—2A shown in FIG. 2. In this illustration a top view of the stirrup 24 is shown. The stirrup bolt 26 is inserted through an aperture along the length of the stirrup with the end of the bolt 26 inserted through the selected apertures 38 and 40 of the tube members 18 and 20 and attached to the locking nut 28. Also in this view an annular cross section of the first tube member 18 and second tube member 20 can be seen. The stirrup 24 includes a first end portion 42 and a second end portion 44. The first end portion 42 of the stirrup 24 has an annular contoured surface 46 which engagingly receives a portion of the side of the first tube 18. The second end portion 44 of the stirrup 24 includes an upwardly extending lip 48. This lip can be seen more clearly in FIG. 2. The lip 48 helps the user of the stilt 10 in centering his foot over the stirrup 24 and between the side of the first tube member 18 and the lip portion 48.

Figure 3:
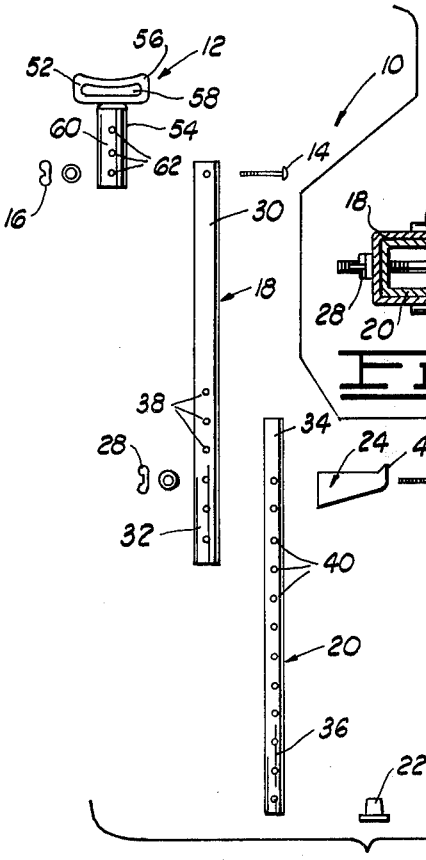
FIG. 3 illustrates one of the stilts with the various elements of the stilt dismantled.

In FIG. 3 the stilt 10 is dismantled thereby illustrating the individual elements that go together to make up the adjustable stilt 10. In this figure the individual apertures 38 in the first tube member 18 and the individual apertures 40 in the second tube member 20 can be seen. Also seen in this figure is the foot piece 22 removed from the lower end portion 36 of the second tube member 20. The foot piece 22 further includes an angular shaped rubber foot pad 49 which slips over the sides of the foot piece 22 securing the foot pad 49 thereto. The foot piece 22 and foot pad 49 are of great help to the user of the stilt 10 by providing a greater area of traction and bearing surface for ease in walking on different ground surface conditions.

The handle 12 includes an upper portion 52 and a lower portion 54. The upper portion 52 of the handle 12 includes a concave shaped hand grip 56 having an aperture 58 therethrough for receiving the fingers of the user of the stilt 10. By contouring the hand grip 56 in a concave position the hand of the user of the stilt 10 is urged into a position centered over the top of the first tube member 18 and second tube member 20. By centering the hand of the user over the tube members 18 and 20, the user of the stilt 10 can more easily be supported by the stilt 10 as he begins learning to walk on the stilt 10.

The lower portion 54 of the handle 12 includes a hollow tubular collar 60 integrally formed with the grip handle 56. The upper end portion 30 of the first tube member 18 is slidably received in the hollow collar 60. The handle 12 can be adjustably attached to the first tube member 18 by selecting apertures 62 which are positioned on opposite sides of the tubular collar 60 and in spaced relationship along the length thereof. When the selected aperture 62 is chosen the handle bolt 14 is inserted therethrough and the locking nut 16 is attached to the end of the bolt 14 thereby securing the handle 12 to the first tube member 18.

Figure 4A:
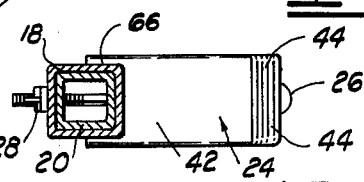
FIG. 4A is a cross section of one stilt taken along lines 4A—4A shown in FIG. 4.
Figure 4:
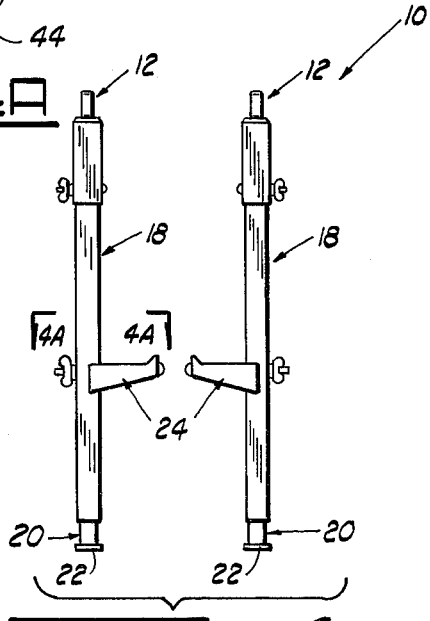
FIG. 4 illustrates the adjustable stilts with an angular cross section and with the height of the foot stirrup raised on the stilt.

In FIG. 4 the stilt 10 is illustrated having an angular cross section. The view of the stilt 10 is similar to the stilt 10 shown in FIG. 1 except for the stirrup 24 which is adjusted on the first tube member 18 and second tube member 20 at a greater height above the ground surface.

In FIG. 4A a cross section of the stilt 10 is shown taken along line 4A—4A. In this illustration the angular construction of the first tube member 18 and second tube member 20 can be seen. Also seen in this view is the first end portion 42 of the stirrup 24 having an angular contoured surface 66 for engaging a portion of the side of the first tube member 18. This angular contoured surface 66 of the stirrup 24 aids in rigidly securing the stirrup 24 against the side of the first tube member 18 when attached thereto by the stirrup bolt 26 and locking nut 28.

Changes may be made in the construction and arrangement of the parts or elements of the embodiments as disclosed herein without departing from the spirit or scope of the invention as defined in the following claims.

We claim:

1. An adjustable stilt for walking on, the stilt comprising:

a vertical first tube member having an upper end portion and a lower end portion, said first tube member having a plurality of apertures positioned on opposite sides thereof and is spaced relationship along the length of said first tube member;

a vertical second tube member having an upper end portion and a lower end portion, the upper end portion of said second tube member slidably received in the lower end portion of said first tube member, said tube member having a plurality of apertures on opposite sides thereof and in spaced relationship along the length of said second tube member;

a horizontal foot stirrup having a stirrup bolt received in an aperture through the length of said stirrup, the end of said bolt received in selected apertures in said first tube member and said second tube member and therethrough, the end of said bolt attached to a locking nut for securing said tube members to each other and to said foot stirrup; and a handle having a hollow collar integrally formed therein, said collar receiving the upper end portion of said first tube member and attached thereto by a handle bolt and a locking nut, said handle having a plurality of apertures on opposite sides of said collar and in a spaced relationship along the length thereof, said handle being adjustable on the upper end portion of said first tube member by indexing the apertures in said collar with the apertures in the upper end portion of said first tube member;

the length of the stilt being adjustable by properly indexing the apertures in said first tube member with the apertures in said second tube members when said first tube member is raised or lowered with respect to said second tube member positioned therein.

2. An adjustable stilt for walking on, the stilt comprising:

a vertical first tube member having an upper end portion and a lower end portion, said first tube member having a plurality of apertures positioned on opposite sides thereof and in spaced relationship along the length of said first tube member;

a vertical second tube member having an upper end portion and a lower end portion, the upper end portion of said second tube member slidably received in the lower end portion of said first tube member, said tube member having a plurality of apertures on opposite sides thereof and in spaced relationship along the length of said second tube member;

a horizontal foot stirrup having a stirrup bolt received in an aperture through the length of said stirrup, the end of said bolt received in selected apertures in said first tube member and said second tube member and therethrough, the end of said bolt attached to a locking nut for securing said tube members to each other and to said foot stirrup, said foot stirrup including a first end portion and a second end portion, the first end portion contoured to engagingly receive a portion of the side of said first tube member when said stirrup is attached thereto, the second end portion having an upwardly extending lip to aid the user of the stilt in positioning his foot on said stirrup and adjacent said first tube member; and a handle having a hollow collar integrally formed therein, said collar receiving the upper end portion of said first tube member and attached thereto by a handle bolt and a locking nut, said handle having a plurality of apertures on opposite sides of said collar and in a spaced relationship along the length thereof, said handle being adjustable on the upper end portion of said first tube member by indexing the apertures in said collar with the apertures in the upper end portion of said first tube member;

the length of the stilt being adjustable by properly indexing the apertures in said first tube member with the apertures in said second tube member when said first tube member is raised or lowered with respect to said second tube member positioned therein.

3. The stilt as described in claim 2 further including a foot piece slidably received in the lower end portion of said second tube member, said foot piece receiving a foot pad therearound for contacting the ground surface when the stilt is in use.

4. The stilt as described in claim 2, wherein said collar, said first tube member, and said second tube member are annular in cross section.

5. The stilt as described in claim 2, wherein said collar, said first tube member, and said second tube member are angular in cross section.

6. The stilt as described in claim 2, wherein said handle includes an upper portion comprising a horizontal handle grip with an aperture therethrough for receiving the fingers of the user of the stilt in gripping said handle, and a lower portion comprising said collar extending vertically downward for receiving the upper end portion of said first member.

7. The stilt as described in claim 2, wherein the top of said handle grip is concave in shape, said concave handle grip helping position the hand of the user of the stilt over the center of said tube members.

* * * * *